US005297459A

United States Patent [19]

Stojanowski

[11] Patent Number: 5,297,459

[45] Date of Patent: Mar. 29, 1994

[54] RATCHETING ADJUSTABLE WRENCH

[76] Inventor: Thomas Stojanowski, 97 Delafield Pl., Staten Island, N.Y. 10310

[21] Appl. No.: 46,602

[22] Filed: Apr. 12, 1993

[51] Int. Cl.[5] ..... B25B 13/14

[52] U.S. Cl. ..... 81/165; 81/158; 81/176

[58] Field of Search ..... 81/155, 157, 158, 165, 81/173, 175, 176, 58, 58.2, 358, 359, 133, 134, 135

[56] References Cited

U.S. PATENT DOCUMENTS 1,171,939 2/1916 Ginsburg ..... 81/165
1,503,662 8/1924 Norton ..... 81/165
2,722,150 11/1955 Green ..... 81/165
3,926,077 12/1975 Nordgren ..... 81/165 X

*Primary Examiner*—D. S. Meislin
*Attorney, Agent, or Firm*—Richard L. Miller

[57] ABSTRACT

A wrench is provided which has a worm gear and mating rack adjustable jaw positioning mechanism for placing a pair of jaws which are adjustable with respect to each other so that they may firmly grip various size nuts, with a mechanism responsive to torque applied in a first direction which causes the jaws to tighten and apply torque to the nut and also responsive to torque applied in a second direction which allows the jaws to separate and ratchet to a new position.

3 Claims, 2 Drawing Sheets

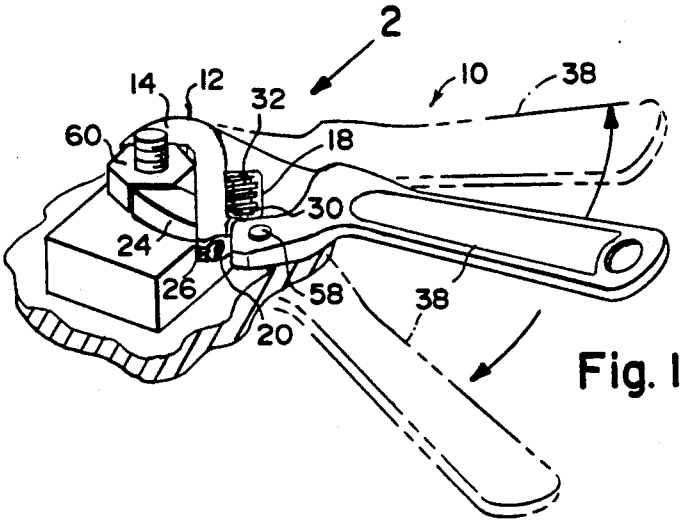
Fig. 1
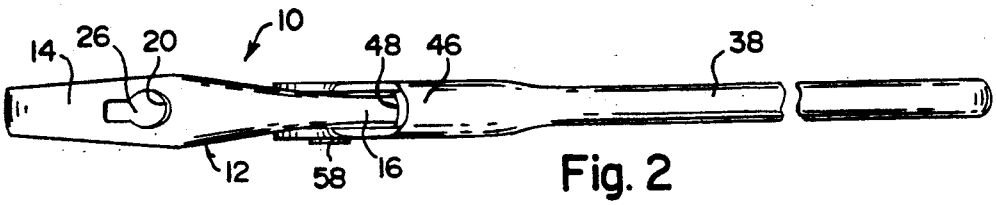
Fig. 2
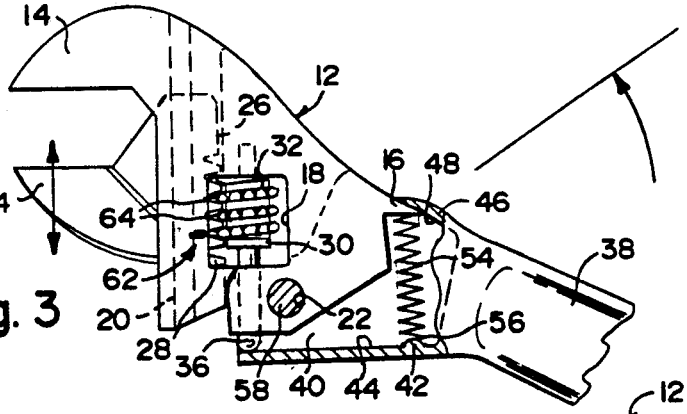
Fig. 3
Fig. 4
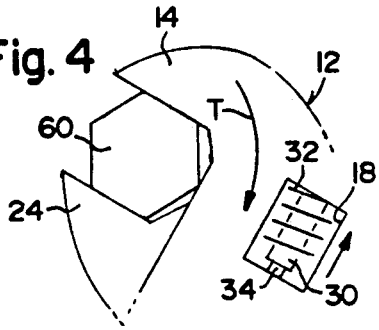
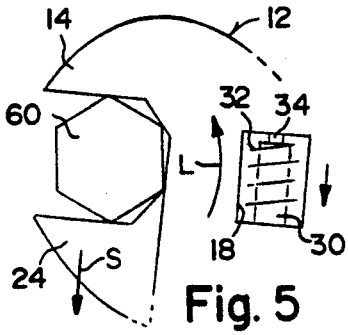
Fig. 5
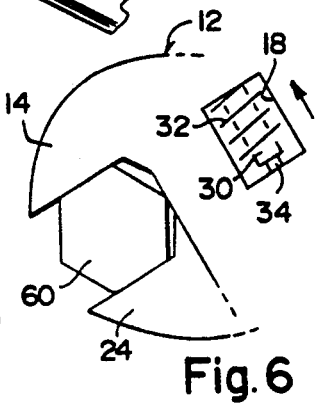
Fig. 6

RATCHETING ADJUSTABLE WRENCH

BACKGROUND OF THE INVENTION

The instant invention relates generally to adjustable open-end wrenches and more specifically it relates to a ratcheting adjustable wrench.

Numerous adjustable open-end wrenches have been provided in the prior art in which each will contain one jaw which is stationary, one jaw which is adjustable and a handle. For example, U.S. Pat. Nos. 3,659,485 to Roth; 3,803,954 to Lenker and 4,924,735 to Lee all are illustrative of such prior art. While these units may be suitable for the particular purpose to which they address, they would not be as suitable for the purpose of the present invention as hereafter described.

SUMMARY OF THE INVENTION

A primary object of the present invention is to provide a ratcheting adjustable wrench that will overcome the shortcomings of the prior art devices.

Another object is to provide a ratcheting adjustable wrench in which a continuous clamping operation is performed by rotating the wrench handle in one direction and then ratcheting in a reverse direction without repeatedly removing the wrench from a nut.

An additional object is to provide a ratcheting adjustable wrench that is incremental adjustable and can be retained in any incremental position.

A further object is to provide a ratcheting adjustable wrench that is simple and easy to use.

A still further object is to provide a ratcheting adjustable wrench that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view illustrating the instant invention in use;

FIG. 2 is an elevational view taken in the direction of arrow 2 in FIG. 1 of just the instant invention per se;

FIG. 3 is a diagrammatic side elevational view with parts broken away illustrating the mechanical cooperation between various parts thereof;

FIGS. 4, 5 and 6 are diagrammatic views illustrating various positions of the instant invention when engaging a typical nut;

DETAILED DESCRIPTION OF THE PREFERRED EMBODIMENTS

Figure 7:
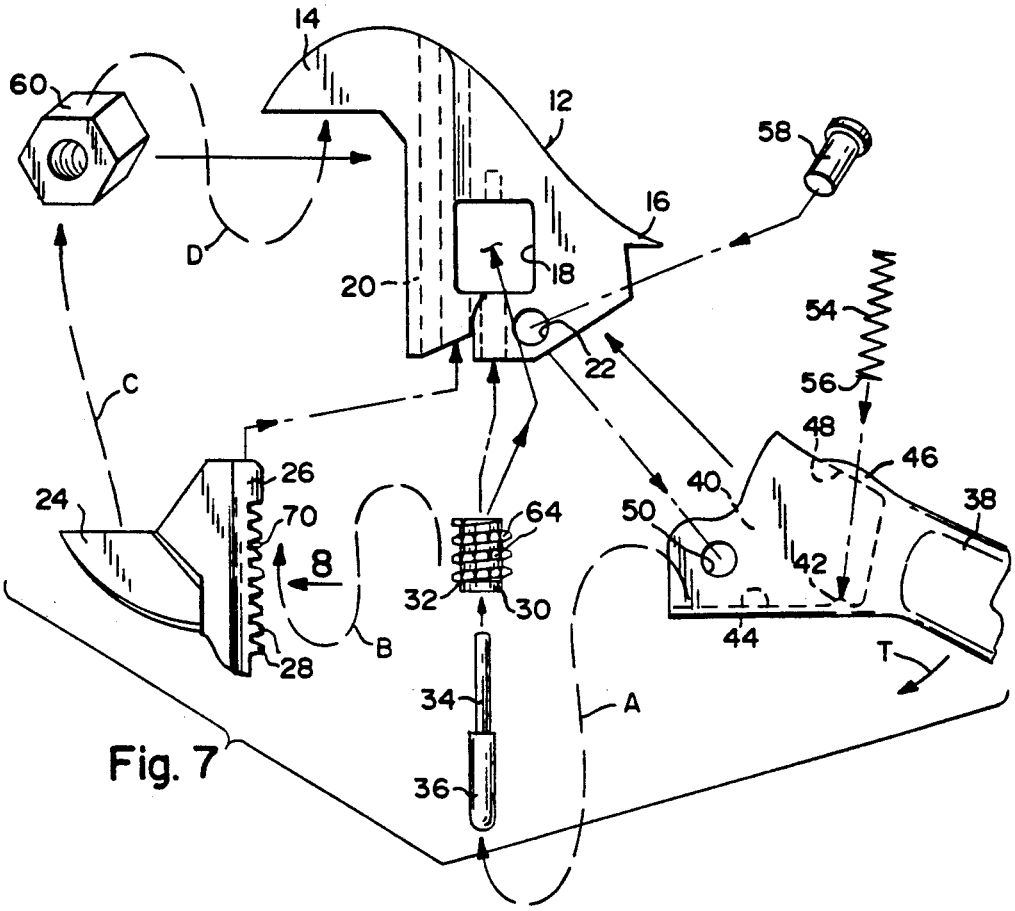
FIG. 7 is a diagrammatic exploded perspective view illustrating how the various components are assembled with each other and the mechanical cooperation between these components.
Figure 8:
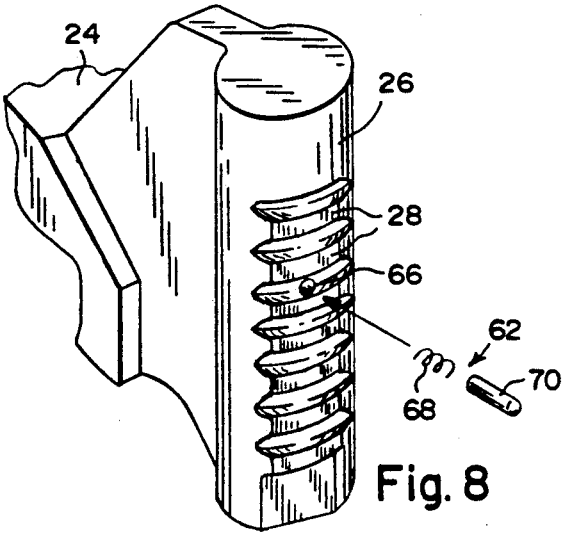
FIG. 8 is an enlarged diagrammatic exploded perspective view with parts broken away illustrating the rack component of the instant invention in greater detail taken generally in the direction of arrow 8 in FIG. 7.
Figure 9:
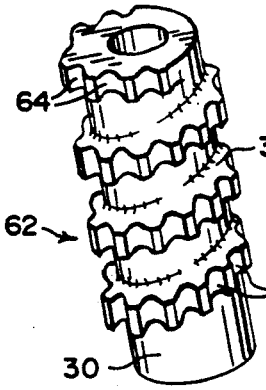
FIG. 9 is an enlarged diagrammatic perspective view of the thumb wheel with the adjusting worm gear.

Turning now descriptively to the drawings, in which similar reference characters denote similar elements throughout the several views, the Figures illustrate a ratcheting adjustable wrench 10 which consists of a head 12 having a fixed jaw 14 extending from one side, a protrusion 16 extending from an opposite side, a laterally extending opening 18 between the fix jaw 14 and the protrusion 16, a longitudinally extending slot 20 between the fixed jaw 14 and the laterally extending opening 18 and a laterally extending hole 22 opposite from the protrusion 16. A movable jaw 24 having a rack 26 with a plurality of teeth 28, is slideably received in the longitudinally extending slot 20, so that the rack teeth 28 will extend into the laterally extending opening 18. A thumb wheel 30, having an adjusting worm gear 32 thereon and a shaft 34 having an enlarged end 36 is provided. The thumb wheel 30 is fit onto the shaft 34, so that the thumb wheel 30 can be rotatively received in the laterally extending opening 18. The worm gear 32 engages with the rack teeth 28 to adjust the movable jaw 24 with respect to the stationary jaw 14. A handle 38 has a recess 40 in one end with a projection 42 formed on a first side 44 of the recess 40. A stop 46 is formed on an opposite second side 48 of the recess 40 and a laterally extending hole 50 extends through the recess 40. A compression spring 54 has one end 56 which fits upon the projection 42 within the recess 40 of the handle 38.

A pivot pin 58 fits through the laterally extending hole 50 at the recess end 40 of the handle 38 and through the laterally extending hole 22 in the head 12. This allows the compression spring 54 to normally force the protrusion 16 of the head 12 against the stop 46 on the second side 48 and the enlarged head 36 of the shaft 34 against the first side 44 of the recess 40. A continuous clamping operation is performed on a nut 60 by rotating the handle 38 in one direction. When the handle 38 is rotated in an opposite direction, if the nut 60 offers sufficient resistance, the head 12 will pivot about the pivot pin 58 overcoming the compression spring 54 to disengage the enlarged head 36 of the shaft 34 from the first side 44 of the recess. This allows the thumb wheel 30 to now slide with the rack 26 on the movable jaw 24, thereby allowing a ratcheting action about the nut 60 without having to repeatedly remove the wrench 10 from the nut 60.

The ratcheting adjustable wrench 10 further includes a structure 62 for retaining the worm gear 32 of the thumb wheel 30 in a stationary incremental position with respect to the rack 26. The thumb wheel 30 will not haphazardly rotate in response to spurious inputs to readjust the movable jaw 24 with respect to the stationary jaw 14 when the wrench 10 is in the ratcheting action process about the nut 60.

The retaining structure 62 consists of the worm gear 32 on the thumb wheel 30 having a plurality of notches 64 therealong. The rack 26 has a bore 66 between two of the teeth 28, while a small spring 68 fits into the bore 66. A follower pin 70 fits into the bore 66 against the small spring 68. The follower 70 will be biased outwardly to engage with one of the notches 64 on the worm gear 32 of the thumb wheel 30 to keep the worm gear 32 in a stationary incremental position with respect to the rack 26.

In operative use FIGS. 4, 5 and 6 show the sequence of the ratcheting process as follows: FIG. 4 illustrates a nut 60 being tightened with the wrench 10 taking a firm grip there upon and according torque T thereby being applied to the nut in a clockwise direction. FIG. 5 shows the wrench being rotated in a counterclockwise direction (arrow L) and the jaws in response appropriately spreading (arrow S) to allow the wrench to take another firm grip upon the nut 60 as seen in FIG. 6. The set of dashed arrows A, B, C and D in FIG. 7 according illustrated the force path whereby the jaws are caused to firmly grip the nut 60 when torque T is applied to handle 38 during a tightening procedure.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ratcheting adjustable wrench which comprises:

a) a head having a fixed jaw extending from one side, a protrusion extending from an opposite side, a laterally extending opening between said fixed jaw and said protrusion, a longitudinally extending slot between said fixed jaw and said laterally extending opening and a laterally extending hole opposite from said protrusion;

b) a moveable jaw having a rack with a plurality of teeth which is slideably received in said longitudinally extending slot, so that said rack teeth will extend into said laterally extending opening;

c) a thumb wheel having an adjusting worm gear thereon;

d) a shaft having an enlarged end, said thumb wheel fitted onto said shaft, so that said thumb wheel can be rotatively received in said laterally extending opening with said worm gear engaging with said rack teeth to adjust said moveable jaw with respect to said stationary jaw;

e) a handle having a recess in one end with a projection formed on a first side of said recess, a stop formed on an opposite second side of said recess and a laterally extending hole through said recess;

f) a compression spring having one end fitted upon said projection within said recess of said handle; and g) a pivot pin which fits through said laterally extending hole at said recess end of said handle and through said laterally extending hole in said head, allowing said compression spring to normally force said protrusion of said head against said stop on said second side and said enlarged head of said shaft against said first side of said recess, so that a continuous clamping operation is performed on a nut by rotating said handle in one direction, while when said handle is rotated in an opposite direction said head will pivot about said pivot pin overcoming said compression spring to disengage said enlarged head of said shaft from said first side of said recess to allow said thumb wheel to now slide with said rack on said moveable jaw thereby allowing a ratcheting action about the nut without having to repeatedly remove said wrench from the nut.

2. A ratcheting adjustable wrench as recited in claim 1, further including means for retaining said worm gear of said thumb wheel in a stationary incremental position with respect to said rack, so that said thumb wheel will not rotate to readjust said moveable jaw with respect to said stationary jaw when said wrench is in said ratcheting action process about the nut.

3. A ratcheting adjustable wrench as recited in claim 2, wherein said retaining means includes:

a) said worm gear on said thumb wheel having a plurality of notches therealong;

b) said rack having a bore between two of said teeth;

c) a small spring to fit into said bore; and d) a follower to fit into said bore against said small spring, so that said follower will be biased outwardly to engage with one of said notches on said worm gear of said thumb wheel to keep said worm gear in a stationary incremental position with respect to said rack.

* * * * *